US011306501B2

(12) United States Patent
Shirley-Smith

(10) Patent No.: US 11,306,501 B2
(45) Date of Patent: Apr. 19, 2022

(54) TRAMPOLINE RETROFIT WITH SIDE WALLS AND CANOPY

(71) Applicant: TENTSILE LTD, London (GB)

(72) Inventor: Alex Shirley-Smith, London (GB)

(73) Assignee: TENTSILE LTD, London (GB)

( * ) Notice: Subject to any disclaimer, the term of this patent is extended or adjusted under 35 U.S.C. 154(b) by 472 days.

(21) Appl. No.: 16/585,001

(22) Filed: Sep. 27, 2019

(65) Prior Publication Data

US 2021/0093939 A1 Apr. 1, 2021

(51) Int. Cl.
*E04H 15/02* (2006.01)
*A63B 5/11* (2006.01)
*A63B 71/02* (2006.01)

(52) U.S. Cl.
CPC ..... *E04H 15/02* (2013.01); *A63B 5/11* (2013.01); *A63B 71/022* (2013.01)

(58) Field of Classification Search
CPC ..... E04H 15/02; A63B 5/11; A63B 1/022
See application file for complete search history.

(56) References Cited

U.S. PATENT DOCUMENTS 4,433,838 A * 2/1984 Gordon ..... A63B 5/11 473/473
4,761,929 A * 8/1988 Zeigler ..... E04H 15/34 52/81.3
6,607,468 B1 * 8/2003 Nichols, Jr. ..... A63B 5/11 482/28
2002/0137598 A1 * 9/2002 Publicover ..... A63B 5/11 482/27
2008/0314427 A1 * 12/2008 Lai ..... A63H 33/008 135/117
2015/0040959 A1 * 2/2015 Andon ..... A63B 71/022 135/161
2017/0080270 A1 * 3/2017 Andon ..... A63B 71/022

* cited by examiner

*Primary Examiner* — Noah Chandler Hawk
(74) *Attorney, Agent, or Firm* — Michael J. Feigin, Esq.; Feigin and Fridman LLC

(57) ABSTRACT

A retrofit trampoline into a gazebo, covered shelter, or the like is created by attaching upward-oriented and/or sideways oriented poles to existing vertical poles of a trampoline. A removable cap is attached to the top of the vertical poles onto which the upward-oriented and/or sideways oriented poles can attach. The sideways oriented polls can be a rollable fabric which can be unrolled to form sidewalls. The upward-oriented poles can meet and/or cross at a horizontal center of the trampoline and/or support a canopy cover which is solid and/or mesh. Seats, such as circumferential seats, which extend around the perimeter of the trampoline inside of the side walls can be added. In some embodiments, a tensioning rope attaches the removable cap to a lower section of the trampoline or ground for support and in some embodiments a tensioning rope is used to hold the cap to the vertical poles.

20 Claims, 8 Drawing Sheets

TRAMPOLINE RETROFIT WITH SIDE WALLS AND CANOPY

FIELD OF THE DISCLOSED TECHNOLOGY

The disclosed technology relates generally to canopies and, more specifically, to a canopy structure designed to be retrofit onto a trampoline.

BACKGROUND OF THE DISCLOSED TECHNOLOGY

A trampoline is a device constructed, for example, of a piece of taut, strong fabric stretched between a steel frame using many coiled springs. People bounce on trampolines for both recreational and competitive purposes.

Historically, a game similar to trampolining was developed by the Inuit, who would toss blanket dancers into the air on a walrus skin one at a time during a spring celebration of whale harvest. There is also some evidence of people in Europe having been tossed into the air by a number of people holding a blanket.

The first modern trampoline was built by George Nissen, a gymnast and diver, and Larry Griswold, a tumbler, in 1936. They had observed trapeze artists using a tight net to add entertainment value to their performance and experimented by stretching a piece of canvas, in which they had inserted grommets along each side, to an angle iron frame by means of coiled springs. It was initially used to train tumblers but soon became popular in its own right. The name was attributed to the Spanish "trampoline," meaning a diving board.

Over the years, trampolines have been used by firefighters, gymnasts, and astronauts-in-training. Commercial trampolines for home use were first sold in the 1970s and have been extremely popular ever since.

Despite the popularity enjoyed by trampolines, today's commercial trampolines are large and expensive enough that many families eschew buying a trampoline in favor of occasional trips to commercial trampoline parks. There is therefore a need for a commercial trampoline which is more versatile than that of the prior art in order to maximize cost-effectiveness.

These and other limitations of the prior art are solved by embodiments described in the present disclosure.

SUMMARY OF THE DISCLOSED TECHNOLOGY

A method of retrofitting a trampoline with side walls and/or top cover, e.g. a tent or yurt structure, is disclosed herein. In order to carry out this method of retrofitting, in an embodiment of the disclosed technology, each of a plurality of added caps is removably connected to a respective top of each of a plurality of vertical poles. Each of a plurality of horizontal poles is removably connected to two of the added caps such that the plurality of horizontal poles substantially form a regular polygon (defined herein as a planar shape with at least 3 straight sides of equal length and a number of angles of an equal number of degrees with the number of angles being equal to the number of straight sides, such as a square, pentagon, hexagon, septagon, or octagon) with vertices (i.e. the angles of the polygon) substantially located at each of the added caps. Further, each of a plurality of side covers is attached to two adjacent vertical poles of the plurality of vertical poles in some embodiments of the disclosed technology. Each side cover of the plurality of side covers is, in embodiments of the disclosed technology, rollable between a rolled state and a hanging state. The term "rolled state" is used herein to refer to a state in which the side cover is furled in a spiral arrangement, such as around the horizontal pole to which it is affixed, whereas the term "hanging state" herein refers to a state in which the side cover is arranged such that one end of the cover is affixed to the horizontal pole (or another horizontal pole) and the rest of the side cover hangs generally and/or substantially in a direction following the vector (pull of) of gravity.

Each of a plurality of upward-extending poles is removably connected to a respective added cap of the plurality of added caps, forming a pyramidal structure. Further, a pyramidal canopy is formed, in some embodiments, over the pyramidal structure by removably connecting a piece of flexible material to each respective upward-extending pole of the plurality of upward-extending poles. The steps described above can be carried out in any order and/or the order listed.

"Retrofit" is defined as "add a component which is lacking in a device and uncontemplated at the time of manufacture." "Upward-extending pole" is a term used herein defined as a pole which is arranged at a diagonal angle relative to the most elongated extent of the plurality of horizontal poles and the plurality of vertical poles. These poles are arranged, in embodiments, in a "pyramidal structure," which is defined as "a structure with three or more sloping edges which extend from substantially a same plane and meet above at a substantially-central point thereof."

"Cap" is herein defined as "a removable cover with a plurality of portals adapted for one or more poles or ropes to be connected there-to." "Horizontal" is herein defined as "substantially in a direction of and/or parallel to a plane of the most elongated flat planar side of a most buoyant section of the trampoline." "Vertical" is herein defined as "substantially perpendicular to the horizontal of the trampoline." "Canopy" is herein defined as "a raised cover." "Removable" is herein defined as "capable of being and/or designed to be placed onto and taken from 100 times or more without structural damage to parts being removed." A "trampoline" is a device with a sheet connected by springs to a frame, or the functional equivalent which allows a person to jump higher than jumping on stationary ground.

In some embodiments of the disclosed technology, the method includes an additional step of removing a plurality of pre-existing caps before the step of removably connecting the added caps. In another embodiment of the disclosed technology, the method includes an additional step of removably connecting each respective side cover of the plurality of side covers to a respective horizontal pole of the plurality of horizontal poles.

In embodiments of the disclosed technology, each added cap of the plurality of added caps is attached to two of the plurality of horizontal poles by way of respective horizontal sockets in the added cap, a vertical pole of the plurality of vertical poles by way of a respective vertically-oriented socket of the added cap, and an upward-extending pole of the plurality of upward-extending poles by way of an upward-angled socket. "Socket" is herein defined as "an opening which is adapted for removably holding a pole used in one or more embodiments of the disclosed technology." In embodiments of the disclosed technology, a substantially straight and/or hollow channel extends between the upward-angled socket and a downward-angled socket. In some embodiments of the disclosed technology, an upward-extending pole of the plurality of upward-extending poles passes through the upward-angled socket, the hollow channel, and the downward-angled socket. The upward-extending pole may extend past and horizontally-outside of an area circumscribed by the regular polygon. The horizontal sockets may be perpendicular to the upward-extending socket and may be placed at an obtuse angle to each other, the obtuse angle being a number of degrees equal to 360/n, n being equal to the number of horizontal poles in the plurality of horizontal poles.

In other words, in embodiments of the disclosed technology, the added cap has one socket which faces conventionally "down" (substantially towards or in a direction of the ground and/or pull of gravity). Above this downward-facing socket are two horizontal sockets which are substantially on the same plane (this plane being perpendicular to the downward socket). These horizontal sockets are at an angle to each other, this angle being a number of degrees equal to 360/n, n being equal to the number of horizontal poles in the plurality of horizontal poles. Finally, the added cap has two more sockets, one being angled slightly away from conventional "up" (defined as opposite of "down", which is defined above) and the other being angled 45° or fewer away from conventional "down." These final two sockets are connected by a substantially or fully straight and hollow channel. The combination of upward-angled socket, channel, and downward-angled socket allows an upward-extending pole to be attached to the added cap in a way that allows it to extend through and out of the added cap (via the downward-angled socket) and to allow a substantial minority (defined as. "an amount between 5% and 33% thereof") extend past and horizontally-outside of an area circumscribed by the regular polygon formed by the plurality of horizontal poles.

In some embodiments of the disclosed technology, the plurality of side covers form a substantially-regular substantially-closed polygon both in the rolled state and/or in the hanging state. The substantially-regular substantially-closed polygon may circumscribe an area which includes an existing net (that is, the created polygonal walls are to the outside of a net) of the trampoline both in the rolled and/or in the hanging state, in some embodiments of the disclosed technology.

In further embodiments of the disclosed technology, the method includes a step of removably connecting a first end of a tensioning rope (i.e. a rope which provides extra stability through an introduction of the pulling force known as "tension") between an end of the upward-extending pole (which is at a position thereof which extends past and horizontally to an outside of an area circumscribed by said regular polygon) and removably connects a second end of the tensioning rope, opposite the first end of the tensioning rope, to a vertical pole of the plurality of vertical poles.

The devices described above, in some embodiments of the disclosed technology, forms a canopy removably attached to a trampoline. The canopy has a plurality of added caps (caps which are attached to vertical poles of a trampoline at tops thereof) connected to a respective top of each of a plurality of vertical poles. The canopy may also have a plurality of horizontal poles, with each horizontal pole of the plurality of horizontal poles being removably connected between two of the added caps such that the plurality of horizontal poles substantially forms a regular polygon with vertices substantially located at each of the added caps. Additionally, the canopy may have a plurality of side covers, each side cover of the plurality of side covers connected between two of the plurality of vertical poles, each side cover of the plurality of side covers being rollable between a rolled state and a hanging state. The canopy, in some embodiments of the disclosed technology, also has a plurality of upward-extending poles, each upward-extending pole of the plurality of upward-extending poles being removably connected to a respective added cap of the plurality of added caps, forming a pyramidal structure; as well as a piece of flexible material removably connected to each respective pole of the plurality of upward-extending poles further forming a pyramidal structure.

In some embodiments of the disclosed technology, each added cap of the plurality of added caps has two horizontal sockets, a vertically-oriented socket, an upward-extending socket, and a downward-extending socket. In some embodiments, the upward-angled socket has a straight and hollow channel opening into the downward-angled socket. The horizontal sockets may be perpendicular to the vertically-oriented socket and may be at an obtuse angle to each other, the obtuse angle being equal to 360/n, n being equal to the number of horizontal poles in the plurality of horizontal poles. In some embodiments of the disclosed technology, each respective added cap of the plurality of added caps is attached to two of the plurality of horizontal poles by way of the horizontal sockets, a vertical pole of the plurality of vertical poles by way of the vertically-oriented socket, and an upward-extending pole of the plurality of upward-extending poles by way of the upward-angled socket. In some embodiments, each respective upward-extending pole of the plurality of upward-extending poles passes there-through the upward-angled socket and the downward-angled socket, extending past and horizontally to an outside of an area circumscribed by the regular polygon.

In some embodiments of the disclosed technology, the piece of flexible material is connected non-removably to the plurality of upward-extending poles. "Non-removable" is defined herein as "designed to be connected for 1 year or more and/or requiring substantially irreversible structural change to a part if removed."

In some embodiments, the piece of flexible material and the plurality of side covers form a unitary structure. In further embodiments, the side covers may form substantially closed sides between said trampoline and said regular polygon in said hanging state. Additionally the plurality of side covers may form a substantially-regular substantially-closed polygon both in the rolled state and in the hanging state, and the substantially-regular substantially-closed polygon in the hanging state may circumscribe an area outside of an existing net of the trampoline.

In embodiments of the disclosed technology, a tensioning rope is removably connected at a first end of the tensioning rope between an end of the upward-extending pole, at a position thereof which extends past and horizontally to an outside of an area circumscribed by the regular polygon, and is removably connected at a second end of the tensioning rope, opposite the first end of the tensioning rope, to a vertical pole of the plurality of vertical poles.

The term "substantially" is defined as "considered to be so by one having ordinary skill in the art of trampolines" and/or "at least 90% of the term being modified by 'substantially.'" More specifically, the term "substantially perpendicular" is defined as "between 150 and 210 degrees" (within 30 degrees of mathematically perpendicular).

The term "generally" used herein is defined as a majority of the modified and described term following the word "generally."

The terms "or" and "and/or" should be interpreted as being inclusive of one or both terms being joined thereby. For example, in the set {A, B}, the phrase "A or B" includes "A," "B," and "A and B."

DETAILED DESCRIPTION OF EMBODIMENTS OF THE DISCLOSED TECHNOLOGY

A retrofit trampoline into a gazebo, covered shelter, or the like is created by attaching upward-oriented and/or sideways oriented poles to existing vertical poles of a trampoline (e.g. poles used to support an existing net). A removable cap (connector device with sockets/portals) is attached to the top of the vertical poles onto which the upward-oriented and/or sideways oriented poles can attach. The sideways oriented polls can be, or can support, a rollable fabric which can be unrolled to form sidewalls. The upward-oriented poles can meet and/or cross at a horizontal center of the trampoline and/or support a canopy cover which is solid (prevents direct sunlight and/or rain) and/or mesh. Thus, either or both of side walls and/or top wall (canopy) can be added to a trampoline. Seats, such as circumferential seats, which extend around the perimeter of the trampoline inside of the side walls can be added. In some embodiments, a tensioning rope attaches the removable cap to a lower section of the trampoline or ground for support and in some embodiments a tensioning rope is used to hold the cap to the vertical poles.

Embodiments of the disclosed technology will become more clear in view of the following discussion of the drawings.

Figure 1:
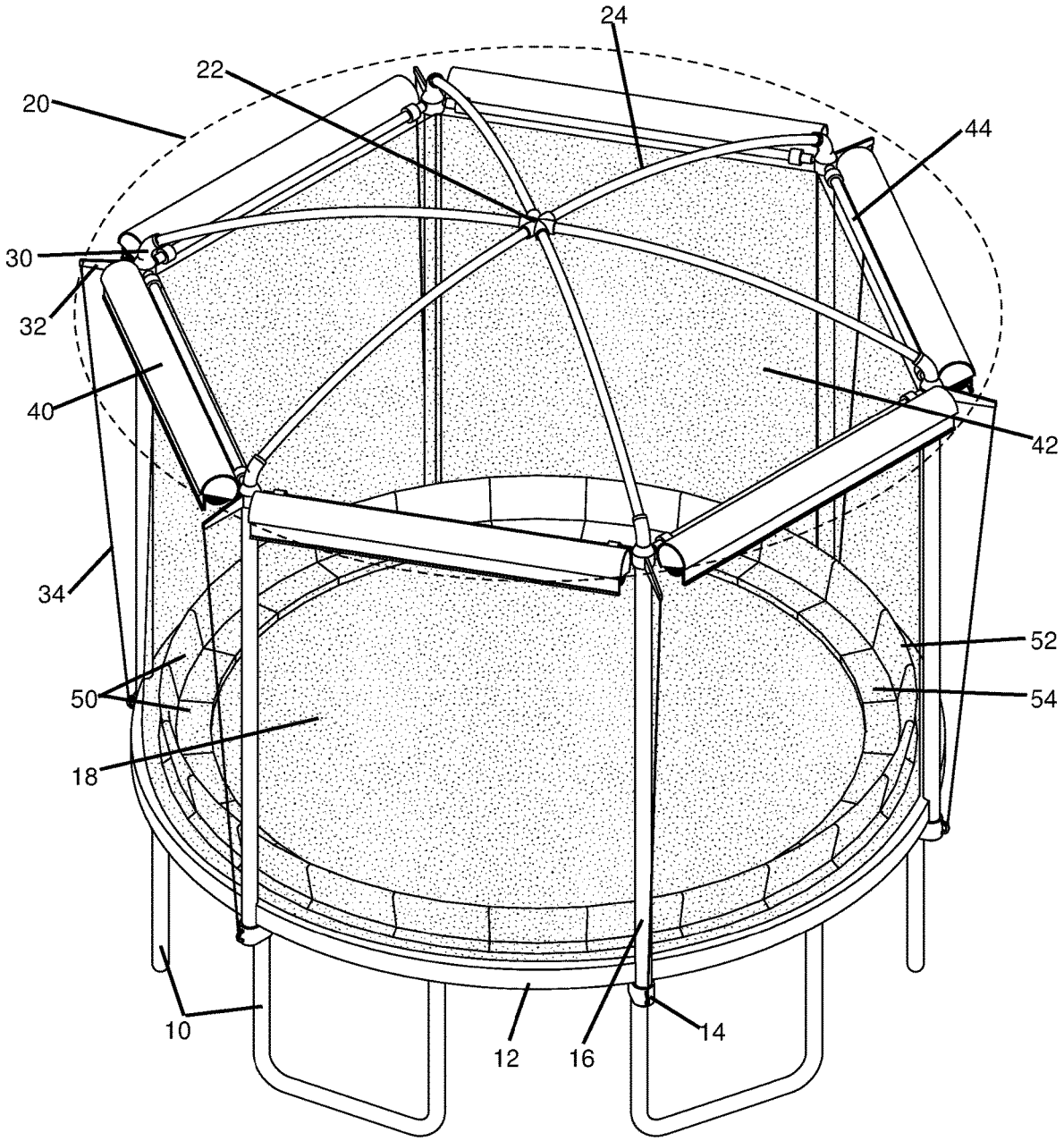
FIG. 1 shows a perspective view of a trampoline with retrofit side walls and cover in an outline view of an embodiment of the disclosed technology.

The following parts list is used to describe the parts shown in the figures:

10 trampoline support
12 trampoline frame
14 lower cap
16 vertical poles
18 trampoline base
19 net of trampoline
20 canopy
22 central upper connector
23 upper portal (alternate)
24 upward-extending poles
30 added cap
31 alternate added cap
32 outward flange of added cap
34 tensioning rope
35 upward-angled socket
36 downward-angled socket
38 horizontal sockets
39 vertical rod
40 side cover holder
42 side cover
44 horizontal pole
45 flexible cover
50 circular seats
52 vertical part of seat
54 horizontal part of seat
60 tension strap FIG. 1 shows a perspective view of a trampoline with retrofit side walls and cover in an outline view of an embodiment of the disclosed technology. In some embodiments, the walls are retrofit on to a trampoline without the cover. In other embodiments, the cover is retrofit on to the trampoline without the side walls. In yet other embodiments, the cover and side walls are both retrofit on to the trampoline. The trampoline base 18 (the flexible and resilient bottom side which is designed for a person to jump there-on) is held by springs or the equivalent to a trampoline frame 12 which is, in some embodiments, a circular rigid frame around the trampoline base 18 which holds the trampoline base 18 taut. The trampoline frame 12 is supported by and held off the ground by trampoline supports, a support structure. This support structure can be a series of feet, U-shaped connectors, or another device or set of devices which rests on the ground or surface beneath while keeping the trampoline base 18 spaced apart form the ground and/or maintains a space between the trampoline base 18 and solid matter there-below. A lower cap which is, in some embodiments, fixedly attached to or forms a part of the trampoline frame 12 has an upward facing portal or socket into which vertical poles 16 are held upright (extending substantially in an upwards direction from the lower cap). A net, such as net 19 shown in FIGS. 2 and 4, extends between/around/inside of the vertical poles 16 and may attach thereto to envelop or surround a plane defined by the trampoline base and parallel planes there-above the trampoline base.

The above paragraph describes an existing trampoline. In embodiments of the present technology, one adds or connects the following elements to an existing trampoline and/or creates as a single unit for sale/construction therewith the following additional elements.

Figure 6:
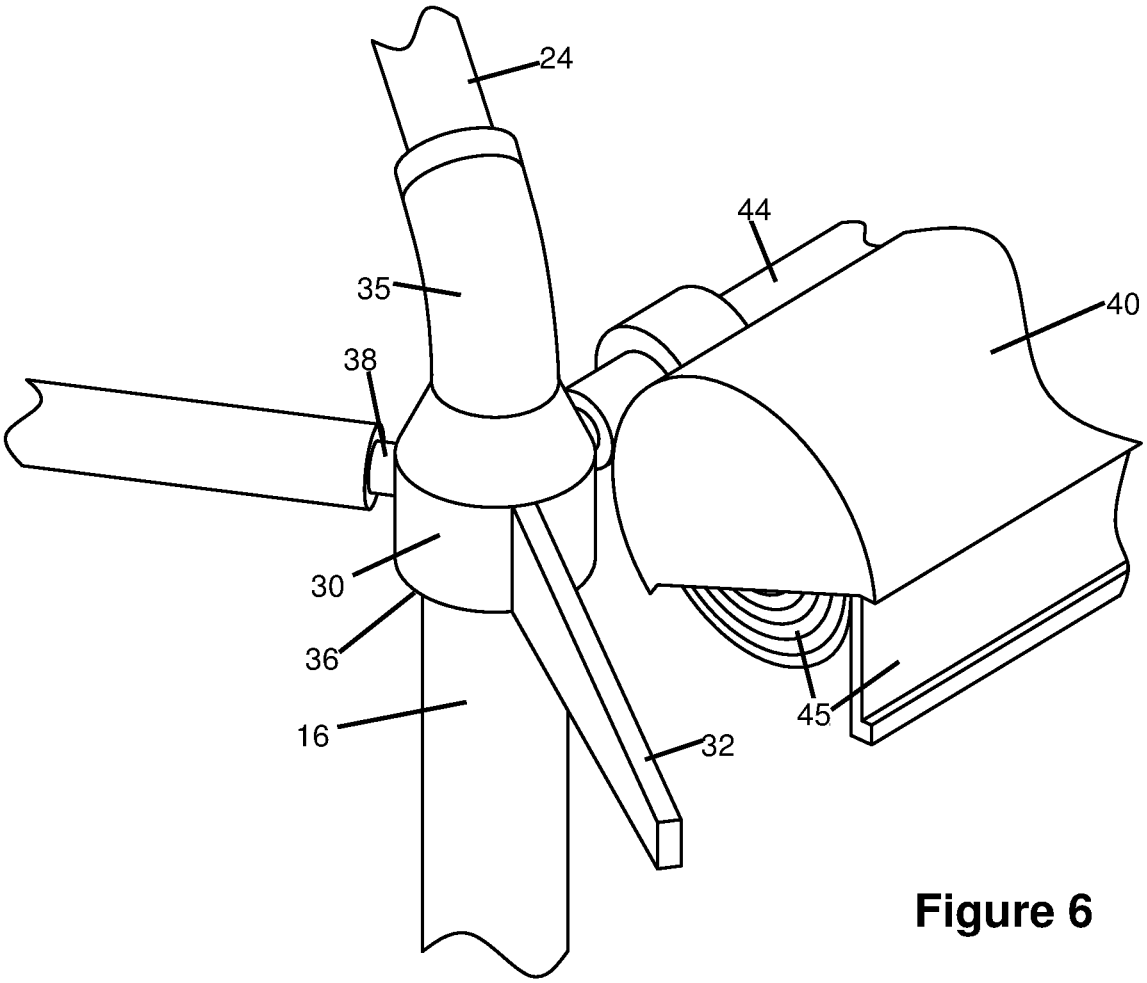
FIG. 6 shows an inset of an added cap (socketed device) used to connect the canopy and/or side walls to the trampoline in embodiments of the disclosed technology.

To the vertical poles 16 is attached an added cap 30 in embodiments of the disclosed technology. Skipping to FIG. 6, FIG. 6 shows an inset of an added cap (socketed device) used to connect the canopy and/or side walls to the trampoline in embodiments of the disclosed technology. Here the vertical pole 16 has the added cap 30 attached to a top side-thereof by way of a downward-oriented socket 36 of the added cap which fits around or onto the vertical pole 16 and stays in place by way of frictional attachment and/or adhesive and/or a fastener passing between each element. Any of the attachments shown or described can attach in such manner or manners. Further, it should be understood that directional descriptors are as they are typically found with a trampoline with the "ground" being at the bottom and "upwards" being away from the ground and/or towards a sky (opposite substantially a direction of a pull of gravity towards the Earth's core).

The added connector 30 further has an upward-oriented socket (portal) 35 to which one of an upward-extending pole 24 of a plurality thereof is attached. Each upward extending pole 24, vertical pole 16, and horizontal pole 44 is attached to a respective added connector 30 to form an enclosed space as shown, such as a regular polygonal closed space between side walls. Still discussing the added connector 30, there are two side portals 38 at an obtuse angle less than 180 degrees to each other (such as a degree measure which is 360 divided by the number of side walls or number of horizontal poles). The "socket" for the horizontal poles can be a male or female socket whereas the attached pole is the opposite thereof. A side cover holder 40 is fixedly or removably attached or connected to a respective horizontal pole 44 and houses a flexible cover 42 shown in a rolled condition 45. The cover 42 can be rolled to substantially or fully fit within an imaginary or actual cylindrical shape created by continuing the circumferential outer shell of the side cover holder 40. The cover 42 can also be pulled out there-from to form a substantially or fully planar wall.

Returning to FIG. 1, one can see the plurality of added connectors 30 at the top of each vertical pole 16. Between each connector is a side cover holder 40 where a side wall can be rolled therein and/or unrolled around the outside of the existing net 19 to form a plurality of side walls 42. From the upwards-oriented socket of the added connector 30 the upward-extending poles 24 join at a central upper connector 22 which has a portal for each respective pole. This can be a pass-thru portal such that each pole 24 extends through one socket and an opposite socket 180 degrees disposed therefrom such that a single pole extends between two added connectors 30. Alternatively, each pole 24 can be a length from an added connector 30 to the central upper connector 22 such that on opposite sides of the upper connector 22 are two different poles. A canopy (flexible or solid cover) 20 is then placed over and/or connects to the upward-extending poles 24 to form a partial or full cover above the trampoline base 18.

Referring now again to FIGS. 6 and 1 simultaneously, an outward flange 32 of the added cap, in some embodiments of the disclosed technology, extends from the added cap outward (away) from a central point of a plane which is parallel to the trampoline base 18 where the plane is at a height of the added cap. This outward flange 32, which in embodiments is outside of a region circumscribed by the side walls 42 and/or vertical poles 16, allows for attachment of a tensioning rope 34 which extends from/connects between the outward flange 32 to one or more of: a) the lower cap 14, b) the trampoline frame 12, c) the ground. The tensioning rope 34 keeps the vertical poles 16 and canopy taut and in place in embodiments of the disclosed technology where the poles are otherwise shaky (movable orientation during use of the trampoline without specific intent to move such objects).

Figure 2:
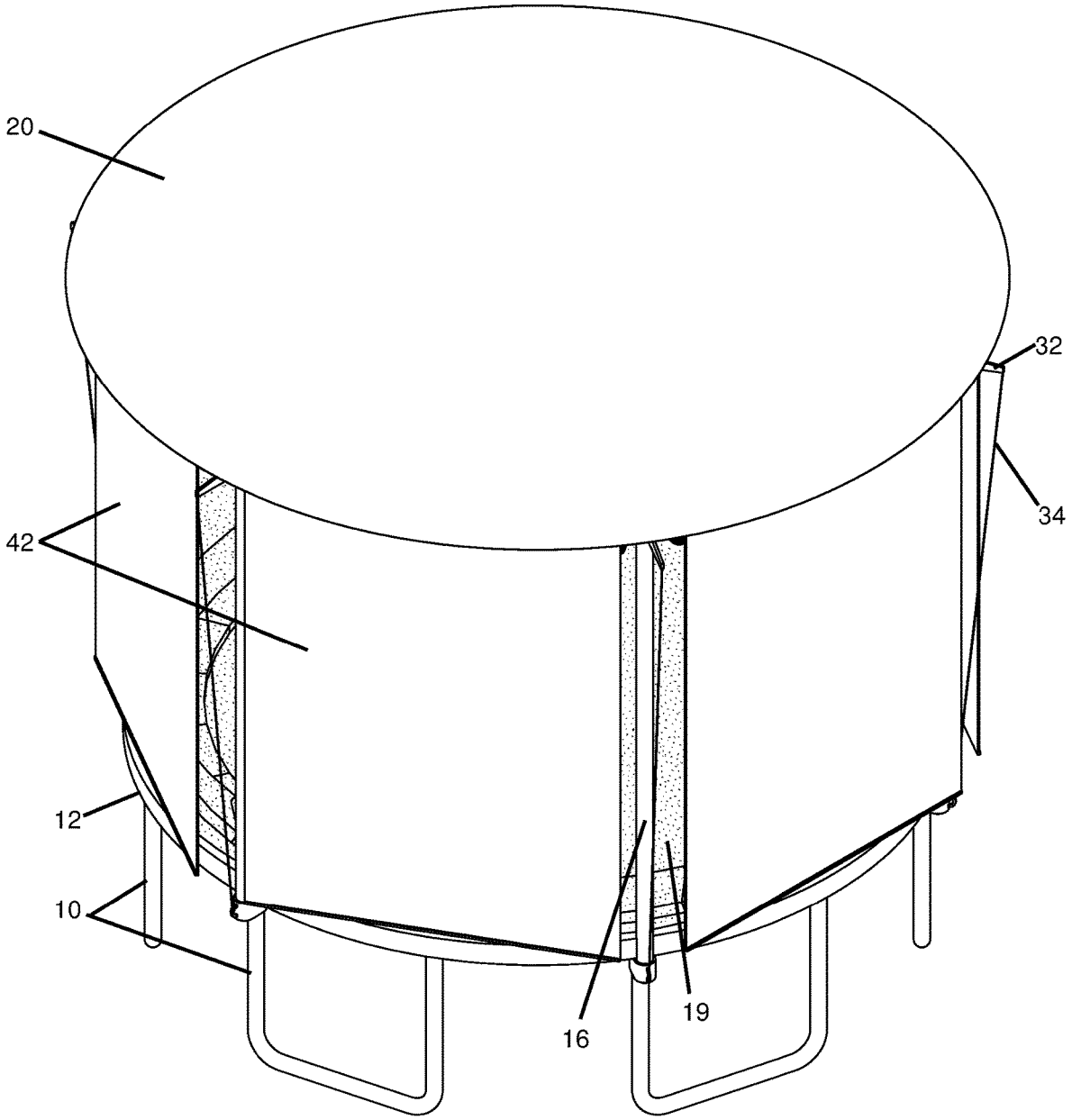
FIG. 2 shows the perspective view of the trampoline with retrofit side walls and cover of FIG. 1 in solid lines.

FIG. 2 shows the perspective view of the trampoline with retrofit side walls and cover of FIG. 1 in solid lines. Here, the covers 42 are extended (unrolled) to form side walls each substantially or fully covering a space between two vertical poles 16. The side walls/covers 42 can be to the outside of an existing or pre-exisiting net 19 of the trampoline. The cover 20 covers an area above the trampoline base 18 and/or above the trampoline frame 12.

Figure 3:
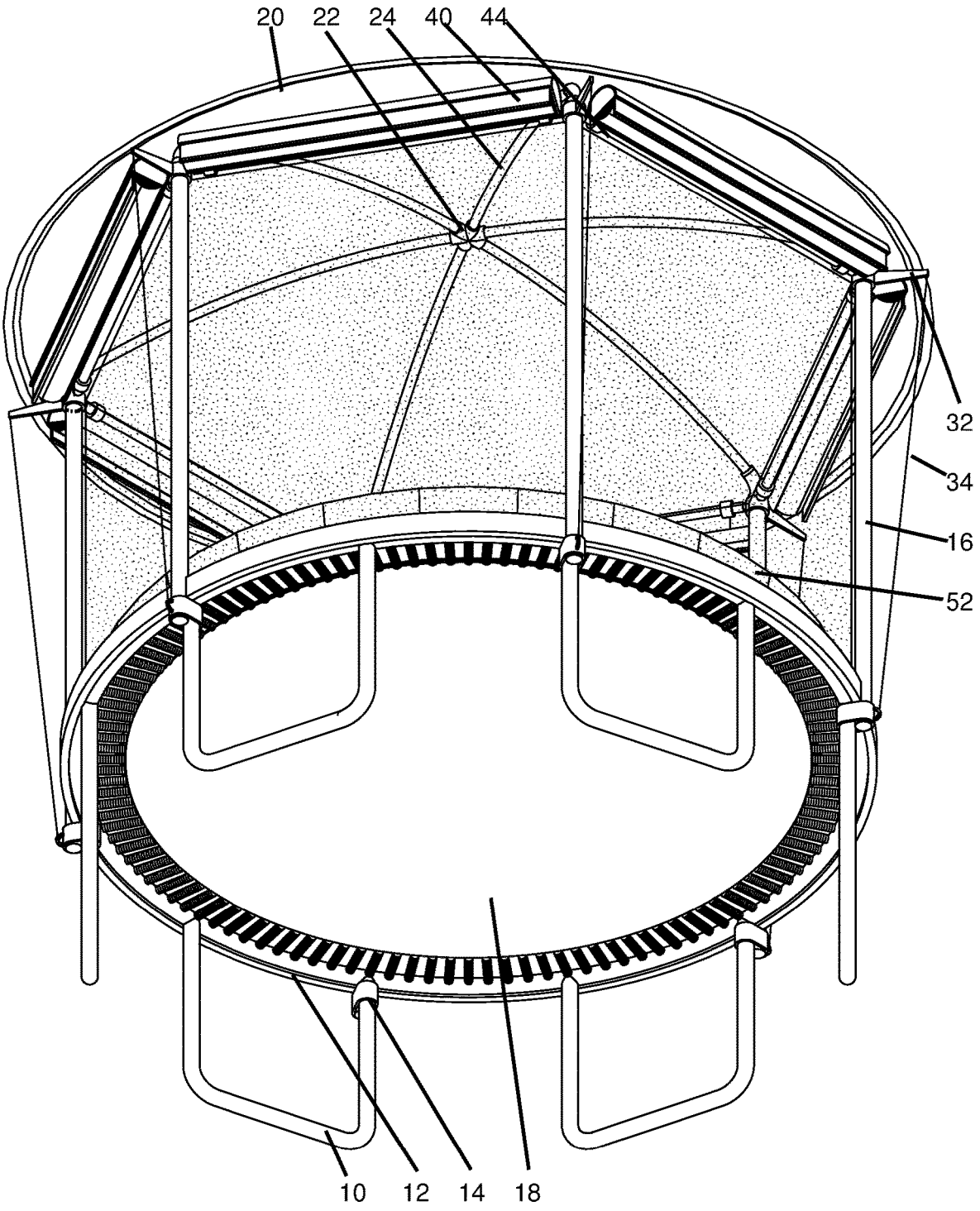
FIG. 3 shows a bottom perspective view of the trampoline with retrofit side walls and cover of an embodiment of the disclosed technology.
Figure 5:
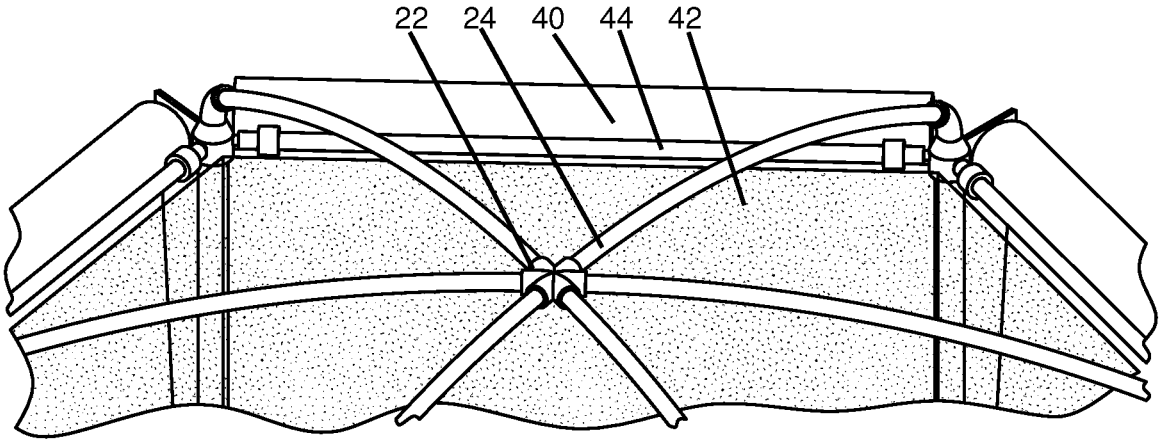
FIG. 5 shows an inset of a canopy support structure used in embodiments of the disclosed technology.

FIG. 3 shows a bottom perspective view of the trampoline with retrofit side walls and cover of an embodiment of the disclosed technology. In this view, the upward-extending poles 24 are visibly supporting and below the canopy 20 with a highest region thereof at the central upper connector 22. Skipping to FIG. 5, FIG. 5 shows an inset of a canopy support structure used in embodiments of the disclosed technology. Here the central upper connector 25 is shown between upward-oriented poles 24 forming a domed shape above the top of the trampoline which helps rainwater, debris, and the like slide off the canopy and fall to the ground rather than inside of a space circumscribed by the side walls 42.

Figure 4:
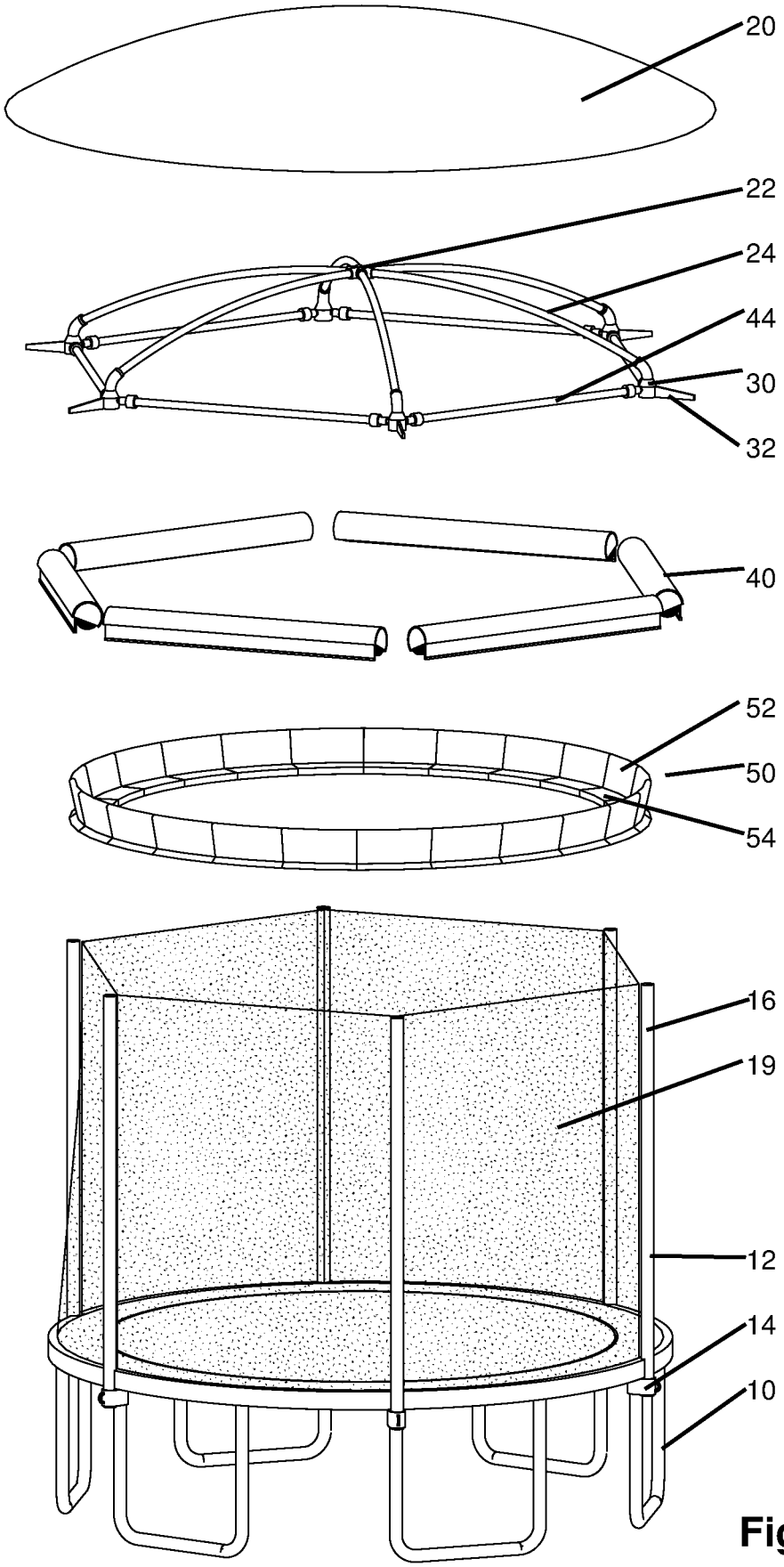
FIG. 4 shows a blown apart view of the trampoline with retrofit side walls in an embodiment of the disclosed technology.

FIG. 4 shows a blown apart view of the trampoline with retrofit side walls in an embodiment of the disclosed technology. An existing trampoline with parts or some parts thereof is in the bottom portion of the picture with numbers from 10 to 19. Added to this, in some embodiments, are seats 50 which sit atop the trampoline base 12. Added to the top side of the existing trampoline are horizontal poles 44 and/or a side cover holder 40 with side covers rolled therein and/or unrollable therefrom. Atop this structure or instead of the side cover holder 40 and/or poles 44, in embodiments of the disclosed technology, is canopy support structure comprising upward-extending poles 24 and/or the horizontal poles 44 and/or added caps 30 and/or the central upper connector 22. Atop this, in some embodiments, is a canopy which can be rigid or flexible and can be removably connected by was fasteners or other connecting mechanism described above, to the canopy support structure.

Discussing now elements 50, 52, and 54 and referring to FIGS. 1 and 4 simultaneously, in some embodiments of the disclosed technology seats are added to the trampoline. The seats can form a "ring" or circumferential shape which fits atop the trampoline base 18 at an outer rim thereof, such as over springs. The seats have, in some embodiments, a horizontal side 54 and vertical side 52 which join together, such as at a right angled or substantially right angled vertex.

Figure 7:
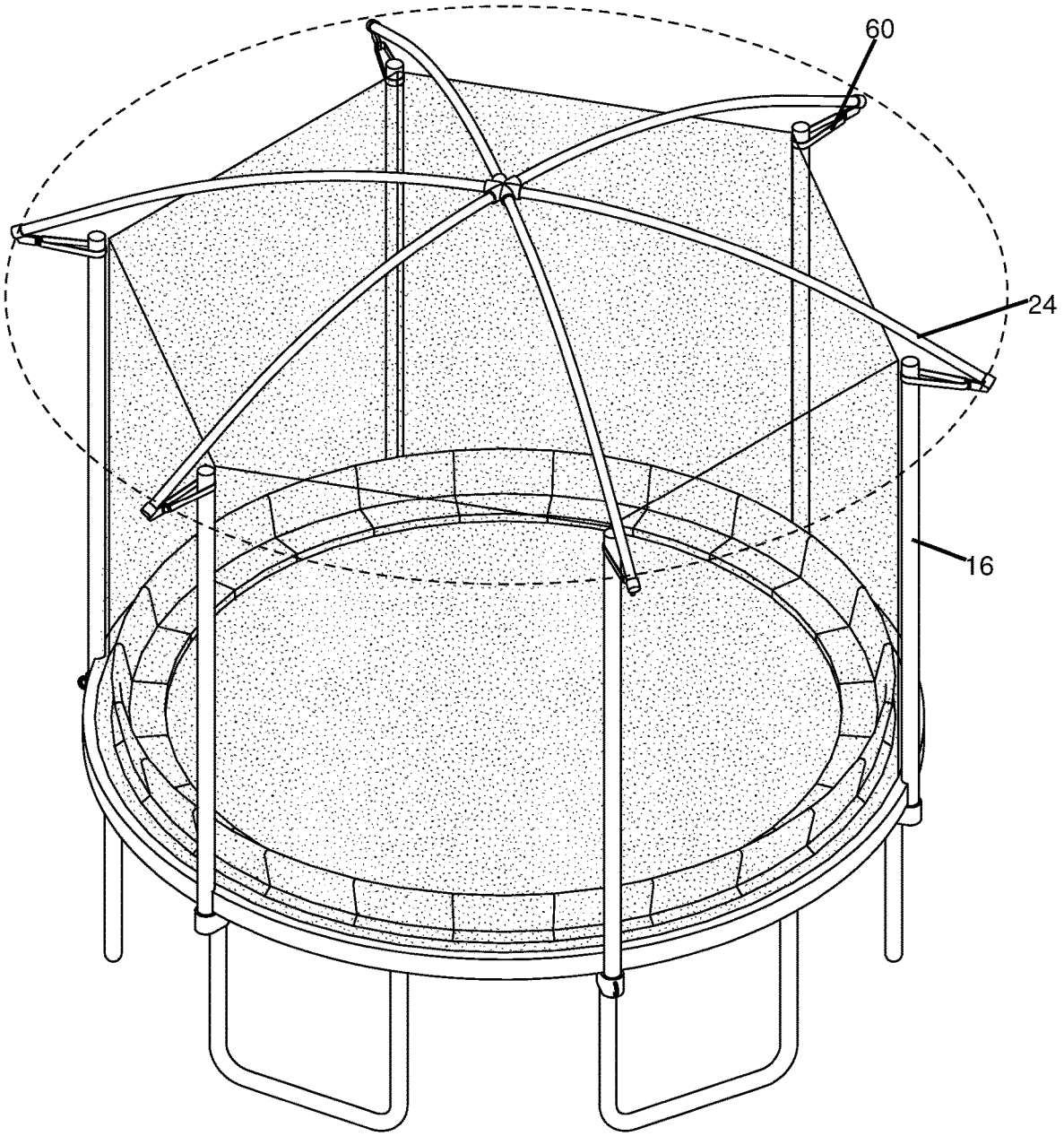
FIG. 7 shows a top perspective view of a canopy attached to a trampoline with tension straps in an embodiment of the disclosed technology.
Figure 8:
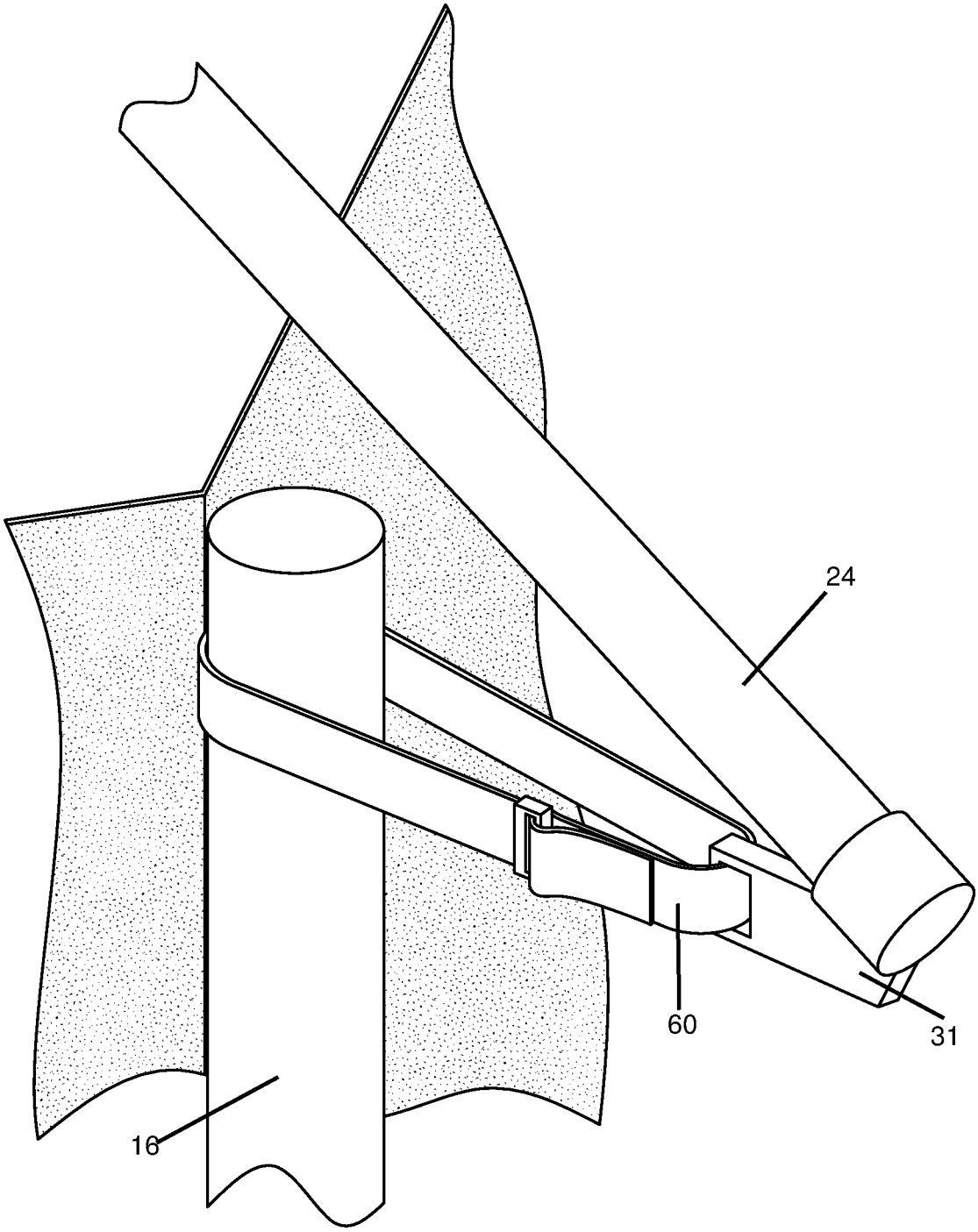
FIG. 8 shows a closeup of a tensioning strap and alternate cap used with the embodiment shown in FIG. 7.

FIG. 7 shows a top perspective view of a canopy attached to a trampoline with tension straps in an embodiment of the disclosed technology. FIG. 8 shows a closeup of a tensioning strap and alternate cap used with the embodiment shown in FIG. 7. In this embodiment an alternate added cap 31 is used which attaches/fastens to a tension strap 60. The tension strap 60 is removably connected to a vertical pole 16 and held taut by an upwardly-oriented pole 24 which connects to the central upper connector 24 and/or another added cap 30/31 on an opposite side of the trampoline. On this structure a canopy 20 and/or side wall 42 can be connected in a cost effective manner.

Figure 9:
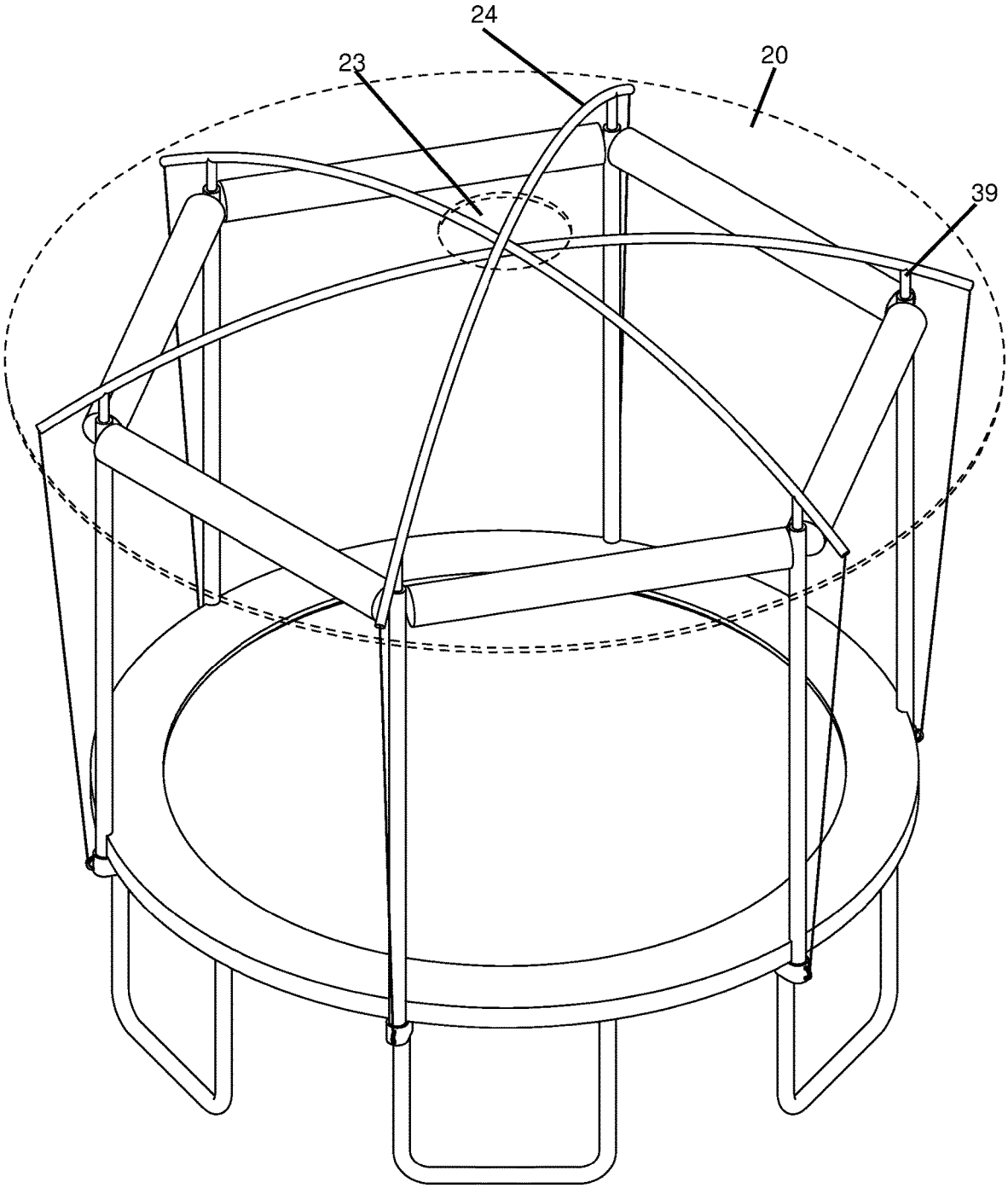
FIG. 9 shows an alternate connection mechanism for a canopy and side walls in an embodiment of the disclosed technology.

FIG. 9 shows an alternate connection mechanism for a canopy and side walls in an embodiment of the disclosed technology. In this embodiment the canopy 22 has an upper portal 23 and the upwardly extending poles 24 have a vertical rod 39 integrated therein which functions as the 'added cap' by extending into or otherwise attaching to a vertical rod 16.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

I claim:

1. A method of retrofitting a trampoline, comprising the steps of:

removably connecting each of a plurality of added caps to a respective top of each of a plurality of vertical poles;

removably connecting each of a plurality of horizontal poles to two of said added caps such that said plurality of horizontal poles substantially forms a regular polygon with vertices substantially located at each of said added caps;

removably connecting each of a plurality of upward-extending poles to a respective added cap of said plurality of added caps, forming a pyramidal structure.

2. The method of claim 1, further comprising an additional step of:

arranging each of a plurality of side covers to two vertical poles of said plurality of vertical poles, each side cover of said plurality of side covers being rollable between a rolled state and a hanging state.

3. The method of claim 2, further comprising an additional step of:

forming a pyramidal canopy over said pyramidal structure by removably connecting a piece of flexible material to each respective upward-extending pole of said plurality of upward-extending poles.

4. The method of claim 2, further comprising an additional step of:

removably connecting each respective side cover of said plurality of side covers to a respective horizontal pole of said plurality of horizontal poles.

5. The method of claim 2, wherein said plurality of side covers form a substantially-regular substantially-closed polygon both in said rolled state and in said hanging state.

6. The method of claim 5, wherein said substantially-regular substantially-closed polygon circumscribes an area which includes an existing net of said trampoline both in said rolled and in said hanging state.

7. The method of claim 1, further comprising an additional step of:

removing a plurality of pre-existing caps before carrying out said step of removably connecting said added caps.

8. The method of claim 1, wherein each said added cap of said plurality of added caps is attached to:

two of said plurality of horizontal poles by way of respective horizontal sockets in said added cap;

a vertical pole of said plurality of vertical poles by way of a respective vertically-oriented socket of said added cap;

an upward-extending pole of said plurality of upward-extending poles by way of an upward-angled socket.

9. The method of claim 8, wherein:

a straight and hollow channel extends between said upward-angled socket and a downward-angled socket;

an upward-extending pole of said plurality of upward-extending poles passes through said upward-angled socket, said hollow channel, and said downward-angled socket; and said upward-extending pole extends past and horizontally-outside of an area circumscribed by said regular polygon.

10. The method of claim 9, further comprising a step of:

removably connecting a first end of a tensioning rope between an end of said upward-extending pole, at a position thereof which extends past and horizontally to an outside of an area circumscribed by said regular polygon; and removably connecting a second end of said tensioning rope, opposite said first end of said tensioning rope, to a vertical pole of said plurality of vertical poles.

11. The method of claim 8, wherein said horizontal sockets are perpendicular to said upward-extending socket and are at an obtuse angle to each other, said obtuse angle being a number of degrees equal to 360/n, n being equal to a number of horizontal poles in said plurality of horizontal poles.

12. A canopy removably attached to a trampoline, said canopy comprising:

a plurality of added caps connected to a respective top of each of a plurality of vertical poles;

a plurality of horizontal poles, each horizontal pole of said plurality of horizontal poles being removably connected between two of said added caps such that said plurality of horizontal poles substantially forms a regular polygon with vertices substantially located at each of said added caps;

a plurality of upward-extending poles, each upward-extending pole of said plurality of upward-extending poles being removably connected to a respective added cap of said plurality of added caps, forming a pyramidal structure;

a piece of flexible material removably connected to each respective pole of said plurality of upward-extending poles further forming a pyramidal structure.

13. The canopy of claim 12, wherein each added cap of said plurality of added caps comprises:

two horizontal sockets;

a vertically-oriented socket;

an upward-extending socket;

a downward-extending socket;

wherein said upward-angled socket has a straight and hollow channel opening into said downward-angled socket.

14. The canopy of claim 13, wherein said horizontal sockets are perpendicular to said vertically-oriented socket and are at an obtuse angle to each other, said obtuse angle being equal to 360/n, n being equal to a number of horizontal poles in said plurality of horizontal poles.

15. The canopy of claim 13, wherein each respective added cap of said plurality of added caps is attached to:

two of said plurality of horizontal poles by way of said horizontal sockets;

a vertical pole of said plurality of vertical poles by way of said vertically-oriented socket;

an upward-extending pole of said plurality of upward-extending poles by way of said upward-angled socket; and wherein each respective upward-extending pole of said plurality of upward-extending poles passes there-through said upward-angled socket and said downward-angled socket, extending past and horizontally to an outside of an area circumscribed by said regular polygon.

16. The canopy of claim 15, wherein a tensioning rope is removably connected at a first end of said tensioning rope between an end of said upward-extending pole, at a position thereof which extends past and horizontally to an outside of an area circumscribed by said regular polygon; and removably connected at a second end of said tensioning rope, opposite said first end of said tensioning rope, to a vertical pole of said plurality of vertical poles.

17. The canopy of claim 13, wherein said piece of flexible material is connected non-removably to said plurality of upward-extending poles.

18. The canopy of claim 13, further comprising a plurality of side covers, each side cover of said plurality of side covers connected between two of said plurality of vertical poles, each side cover of said plurality of side covers being rollable between a rolled state and a hanging state; wherein said piece of flexible material and said plurality of side covers form a unitary structure.

19. The canopy of claim 18, wherein said side covers form substantially closed sides between said trampoline and said regular polygon in said hanging state.

20. The canopy of claim 18, wherein said plurality of side covers form a substantially-regular substantially-closed polygon both in said rolled state and in said hanging state, and wherein said substantially-regular substantially-closed polygon in said hanging state circumscribes an area outside of an existing net of said trampoline.

* * * * *